US008999114B2

(12) United States Patent
Yin

(10) Patent No.: US 8,999,114 B2
(45) Date of Patent: Apr. 7, 2015

(54) BCTMP FILTRATE RECYCLING SYSTEM AND METHOD

(71) Applicant: International Paper Company, Memphis, TN (US)

(72) Inventor: Caifang F. Yin, Mason, OH (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 14/192,954

(22) Filed: Feb. 28, 2014

(65) Prior Publication Data

US 2014/0174679 A1 Jun. 26, 2014

Related U.S. Application Data

(62) Division of application No. 13/051,103, filed on Mar. 18, 2011, now Pat. No. 8,753,477.

(51) Int. Cl.
*D21C 9/02* (2006.01)
*D21C 9/18* (2006.01)
(Continued)

(52) U.S. Cl.
CPC ..... *D21C 9/10* (2013.01); *D21C 11/0028* (2013.01); *D21C 9/02* (2013.01); *D21C 11/0021* (2013.01); *D21C 9/163* (2013.01); *D21C 11/0014* (2013.01); *Y10S 162/08* (2013.01)

(58) Field of Classification Search
CPC .... D21C 9/02; D21C 9/1057; D21C 11/0014; D21C 11/0021; D21C 11/0028; Y10S 162/08
USPC ..... 162/41, 60, DIG. 8
See application file for complete search history.

(56) References Cited

U.S. PATENT DOCUMENTS
3,698,995 A 10/1972 W.H. Rapson
3,867,197 A 2/1975 Reinhardt et al.
(Continued)

FOREIGN PATENT DOCUMENTS
CA 2096891 11/1993
DE 4314521 11/1994
(Continued)

OTHER PUBLICATIONS
Smook, Handbook for Pulp and Paper Technologists, 1992, Angus Wilde Publications, 2nd edition, chapter 16.*
(Continued)

*Primary Examiner* — Anthony Calandra
(74) *Attorney, Agent, or Firm* — Thomas W. Barnes, III

(57) ABSTRACT
A process for making bleached pulp comprises contacting an unbleached pulp mixture with a first recycled filtrate obtained from a first location (3) of a first recycled filtrate loop, to obtain a first pulp mixture having a first consistency; bleaching the first pulp mixture, to obtain a first bleached pulp mixture; pressing or dewatering the first bleached pulp mixture, to obtain a first pressed bleached pulp mixture and a second filtrate; sending at least a portion of the second filtrate to a second location (5) of the first recycled filtrate loop, wherein the second location (5) is downstream of and in fluid communication with the first location (3); contacting the first pressed bleached pulp mixture with a second recycled filtrate obtained from a third location (6) of the first recycled filtrate loop, to obtain a second pulp mixture having a second consistency, wherein the second consistency is greater than the first consistency, and wherein the third location (6) is downstream of and in fluid communication with the second location (5); bleaching the second pulp mixture, to obtain a second bleached pulp mixture; pressing or dewatering the second bleached pulp mixture, to obtain a second pressed bleached pulp mixture and a third filtrate; sending at least a portion of the third filtrate to a fourth location (8) of the first recycled filtrate loop, wherein the fourth location (8) is downstream of and in fluid communication with the third location (6); and recycling at least a portion of the third filtrate in the first recycled filtrate loop to the first location (3); to obtain the bleached pulp.

9 Claims, 13 Drawing Sheets

(51) Int. Cl.

| | |
|---|---|
| ***D21C 9/10*** | (2006.01) |
| ***D21C 11/00*** | (2006.01) |
| *D21C 9/16* | (2006.01) |

(56) References Cited

U.S. PATENT DOCUMENTS

| | | | |
|---|---|---|---|
| 3,961,976 | A | 6/1976 | Karlsson |
| 3,974,266 | A | 8/1976 | Fuller |
| 3,975,505 | A | 8/1976 | Fuller |
| 3,976,758 | A | 8/1976 | Fuller |
| 4,000,033 | A | 12/1976 | Nicolle et al. |
| 4,014,736 | A | 3/1977 | Sexton |
| 4,039,372 | A | 8/1977 | Reeve et al. |
| 4,042,452 | A | 8/1977 | Arhippainen et al. |
| 4,046,621 | A | 9/1977 | Sexton |
| 4,104,114 | A | 8/1978 | Rowlandson et al. |
| 4,483,740 | A | 11/1984 | Parkinson et al. |
| 2,590,140 | A | 3/1985 | Wolf |
| 4,529,479 | A | 7/1985 | Tuomi |
| 4,588,414 | A | 5/1986 | Takegami et al. |
| 4,735,684 | A | 4/1988 | Seymour |
| 4,938,943 | A | 7/1990 | Norell |
| 4,944,842 | A | 7/1990 | Stromberg et al. |
| 5,116,595 | A | 5/1992 | Scribner et al. |
| 5,120,448 | A | 6/1992 | Dorica et al. |
| 5,122,240 | A | 6/1992 | Cowley et al. |
| 5,149,442 | A | 9/1992 | Nystrom et al. |
| 5,164,043 | A | 11/1992 | Griggs et al. |
| 5,198,080 | A | 3/1993 | Cowley et al. |
| 5,256,261 | A | 10/1993 | Lipsztajn et al. |
| 5,277,768 | A | 1/1994 | Twardowski |
| 5,283,054 | A | 2/1994 | Copenhafer et al. |
| 5,352,332 | A | 10/1994 | Maples et al. |
| 5,376,350 | A | 12/1994 | Tenney et al. |
| 5,399,332 | A | 3/1995 | Pu |
| 5,401,362 | A | 3/1995 | Lindberg |
| 5,423,959 | A | 6/1995 | Sundblad et al. |
| 5,549,788 | A | 8/1996 | Nykanen et al. |
| 5,593,653 | A | 1/1997 | Scribner et al. |
| 5,626,717 | A | 5/1997 | Yin et al. |
| 5,853,535 | A | 12/1998 | Maples et al. |
| 5,938,892 | A | 8/1999 | Maples et al. |
| 5,968,317 | A | 10/1999 | Gartz et al. |
| 6,106,667 | A | 8/2000 | Henricson |
| 6,126,702 | A | 10/2000 | Liu et al. |
| 6,153,051 | A | 11/2000 | Tsai |
| 6,569,284 | B1 | 5/2003 | Yin et al. |
| 7,077,931 | B2 | 7/2006 | Snekkenes et al. |
| 7,182,835 | B2 | 2/2007 | Lindstrom et al. |
| 7,374,637 | B2 | 5/2008 | Snekkenes et al. |
| 2002/0088567 | A1 | 7/2002 | Henricson et al. |
| 2002/0108728 | A1 | 8/2002 | Salminen |
| 2004/0149404 | A1 | 8/2004 | Snekkenes et al. |
| 2006/0090865 | A1 | 5/2006 | Snekkenes et al. |
| 2006/0090866 | A1 | 5/2006 | Gustavsson et al. |
| 2011/0232853 | A1 | 9/2011 | Yin |
| 2012/0279669 | A1 | 11/2012 | Vehmaa et al. |

FOREIGN PATENT DOCUMENTS

| | | |
|---|---|---|
| EP | 0564443 | 10/1993 |
| EP | 1443144 | 1/2004 |
| SE | 81020828 | 4/1981 |
| WO | 9413591 | 6/1994 |
| WO | 9966120 | 12/1999 |
| WO | 2008152187 | 12/2008 |

OTHER PUBLICATIONS

The basics of hardwood BCTMP, Thomas Granfeldt and Vesa Suhonen, Fiber and Paper, vol. 5, issue 1, 2003, p. 40-43.

* cited by examiner

Second Recycled Filtrate Loop

BCTMP FILTRATE RECYCLING SYSTEM AND METHOD

BACKGROUND

Field of the Invention

The present disclosure relates to a system and method for bleached pulp filtrate recycling, bleached pulps produced thereby, and paper produced thereby.

BRIEF DESCRIPTION OF THE FIGURES

Various embodiments are described in conjunction with the accompanying figures.

Figure 1:
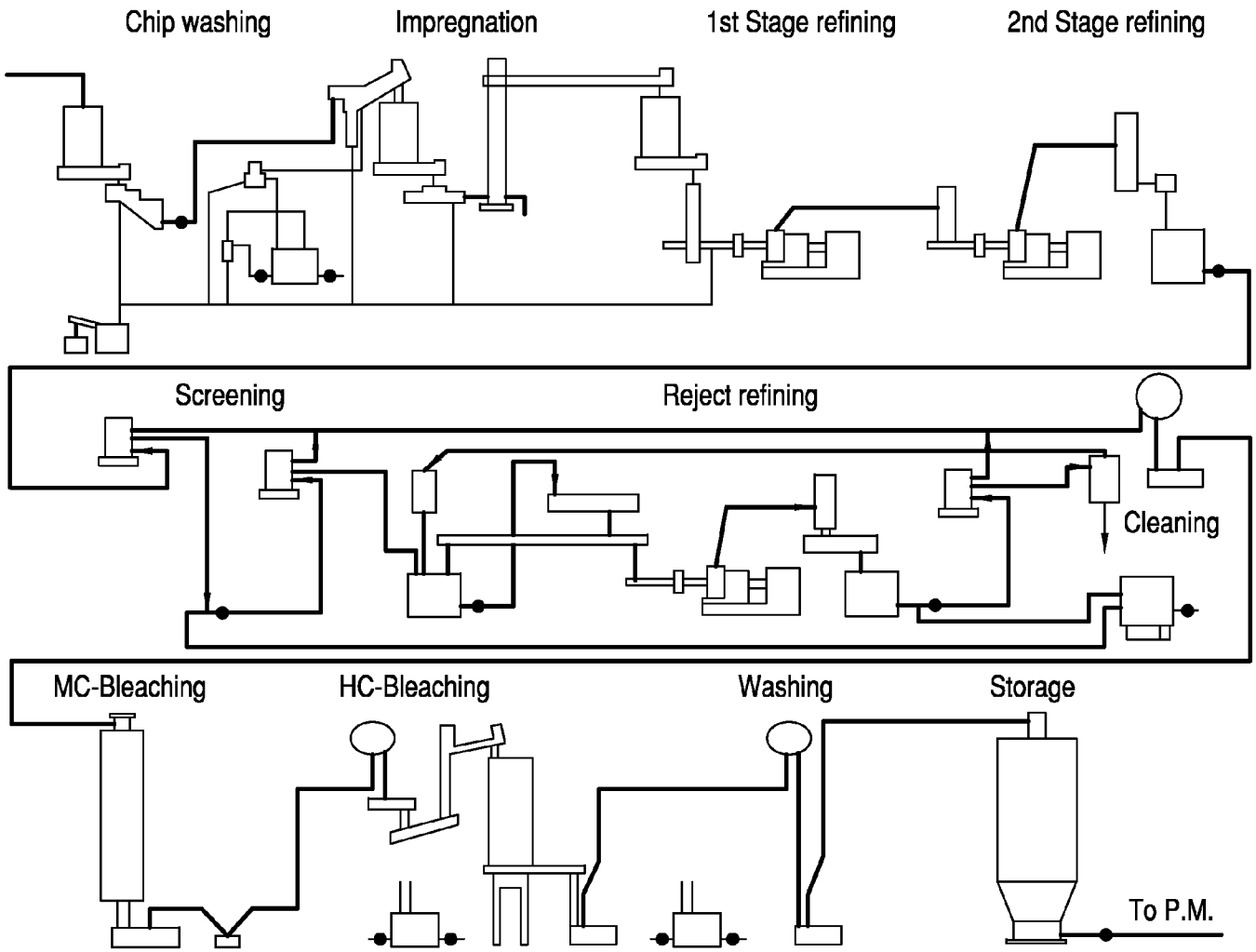
FIG. 1 shows a conventional flow diagram of a conventional bleached chemical thermomechanical pulp (BCTMP) process and unit operations equipment. Medium consistency ("MC") and high consistency ("HC") bleaching stages are shown. The MC and HC bleaching stages are typically carried out using conventional countercurrent filtrate recycling.

Generally, in the figures, as shown in the legends, the arrows show the direction of pulp flow and filtrate flow direction in the process or plant. The bold arrows represent the flow direction of the pulp as it moves through the process or plant. The narrow lines represent the flow direction of the various filtrates, diluents, and the like. The dashed lines represent optional embodiments.

In one embodiment, the figures describe a process. In another embodiment, the figures describe an apparatus.

DETAILED DESCRIPTION OF THE SEVERAL EMBODIMENTS

One embodiment provides a process for making bleached pulp, comprising:

(a) contacting an unbleached pulp mixture with a first recycled filtrate obtained from a first location (3) of a first recycled filtrate loop, to obtain a first pulp mixture having a first consistency;

(b) bleaching the first pulp mixture, to obtain a first bleached pulp mixture;

(c) pressing or dewatering the first bleached pulp mixture, to obtain a first pressed bleached pulp mixture and a second filtrate;

(d) sending at least a portion of the second filtrate to a second location (5) of the first recycled filtrate loop, wherein the second location (5) is downstream of and in fluid communication with the first location (3);

(e) contacting the first pressed bleached pulp mixture with a second recycled filtrate obtained from a third location (6) of the first recycled filtrate loop, to obtain a second pulp mixture having a second consistency, wherein the second consistency is greater than the first consistency, and wherein the third location (6) is downstream of and in fluid communication with the second location (5);

(f) bleaching the second pulp mixture, to obtain a second bleached pulp mixture;

(g) pressing or dewatering the second bleached pulp mixture, to obtain a second pressed bleached pulp mixture and a third filtrate;

(h) sending at least a portion of the third filtrate to a fourth location (8) of the first recycled filtrate loop, wherein the fourth location (8) is downstream of and in fluid communication with the third location (6); and (i) recycling at least a portion of the third filtrate in the first recycled filtrate loop to the first location (3);

to obtain the bleached pulp.

One embodiment provides a process further comprising, prior to (a), diluting, pressing or dewatering, or diluting and pressing or dewatering a first unbleached pulp mixture to produce the unbleached pulp mixture.

One embodiment provides a process further comprising, prior to (a), diluting a first unbleached pulp mixture to produce the unbleached pulp mixture.

One embodiment provides a process further comprising, prior to (a):

pressing or dewatering a first unbleached pulp mixture to produce the unbleached pulp mixture and a first filtrate; and sending at least a portion of the first filtrate to a first location (2) of the second recycled filtrate loop.

One embodiment provides a process, wherein the second recycled filtrate loop is not in fluid communication with the first recycled filtrate loop.

One embodiment provides a process, wherein the first recycled filtrate loop comprises a residual bleaching agent.

One embodiment provides a process, wherein the second recycled filtrate loop is substantially free of residual bleaching agent.

One embodiment provides a process, wherein the second recycled filtrate loop is in fluid communication with the first recycled filtrate loop to either control a fluid level in the first recycled filtrate loop, to dilute a residual bleaching agent level in the first recycled filtrate loop, or a combination thereof.

One embodiment provides a process, wherein the first recycled filtrate loop contains a higher concentration of residual bleaching agent than does the second recycled filtrate loop.

One embodiment provides a process, further comprising diluting the first unbleached pulp mixture prior to pressing or dewatering the first unbleached pulp mixture.

One embodiment provides a process, further comprising one or more of sending at least a portion of the first filtrate in the second recycled filtrate loop to an upstream storage tank, sending at least a portion of the first filtrate in the second recycled filtrate loop upstream to dilute the first unbleached pulp mixture prior to dewatering the first unbleached pulp mixture.

One embodiment provides a process, further comprising, after (i):

contacting the second pressed bleached pulp mixture with a third recycled filtrate obtained from a second location (9) of a second recycled filtrate loop, to produce a third pulp mixture.

One embodiment provides a process, wherein the second recycled filtrate loop is not in fluid communication with the first recycled filtrate loop.

One embodiment provides a process, wherein the first recycled filtrate loop comprises a residual bleaching agent.

One embodiment provides a process, wherein the second recycled filtrate loop is substantially free of residual bleaching agent.

One embodiment provides a process, wherein the second recycled filtrate loop is in fluid communication with the first recycled filtrate loop to either control a fluid level in the first recycled filtrate loop, to dilute a residual bleaching agent level in the first recycled filtrate loop, or a combination thereof.

One embodiment provides a process, wherein the first recycled filtrate loop contains a higher concentration of residual bleaching agent than does the second recycled filtrate loop.

One embodiment provides a process, further comprising diluting the third pulp mixture.

One embodiment provides a process, further comprising diluting the third pulp mixture with a recycled filtrate obtained from a location (10) of the second recycled filtrate loop, wherein the location (10) is downstream of the second location (9).

One embodiment provides a process, further comprising, after (i):

pressing or dewatering the second pressed bleached pulp mixture to obtain the bleached pulp and a fourth filtrate; and sending at least a portion of the fourth filtrate to a third location (11) of the second recycled filtrate loop.

One embodiment provides a process, wherein the second recycled filtrate loop is not in fluid communication with the first recycled filtrate loop.

One embodiment provides a process, wherein the first recycled filtrate loop comprises a residual bleaching agent.

One embodiment provides a process, wherein the second recycled filtrate loop is substantially free of residual bleaching agent.

One embodiment provides a process, wherein the second recycled filtrate loop is in fluid communication with the first recycled filtrate loop to either control a fluid level in the first recycled filtrate loop, to dilute a residual bleaching agent level in the first recycled filtrate loop, or a combination thereof.

One embodiment provides a process, wherein the first recycled filtrate loop contains a higher concentration of residual bleaching agent than does the second recycled filtrate loop.

One embodiment provides a process, further comprising sending at least a portion of the fourth filtrate in the second recycled filtrate loop to an upstream storage tank.

One embodiment provides a process, further comprising sending at least a portion of the fourth filtrate in the second recycled filtrate loop to the first recycled filtrate loop to either control a fluid level in the first recycled filtrate loop, to dilute a residual bleaching agent level in the first recycled filtrate loop, or a combination thereof.

One embodiment provides a process, further comprising diluting the second pressed bleached pulp mixture prior to pressing or dewatering the second pressed bleached pulp mixture.

One embodiment provides a process, further comprising storing the bleached pulp.

One embodiment provides a process, further comprising one or more of sending at least a portion of the fourth filtrate in the second recycled filtrate loop to an upstream storage tank; sending at least a portion of the fourth filtrate in the second recycled filtrate loop upstream for contacting with the second pressed bleached pulp mixture; sending at least a portion of the fourth filtrate in the second recycling loop to the first recycled filtrate loop to either control a fluid level in the first recycled filtrate loop, to dilute a residual bleaching agent level in the first recycled filtrate loop, or a combination thereof; or a combination thereof.

One embodiment provides a process, further comprising, after (i):

contacting the second pressed bleached pulp mixture with a third recycled filtrate obtained from a second location (9) of a second recycled filtrate loop, to produce a third pulp mixture;

pressing or dewatering the third pulp mixture to obtain the bleached pulp and a fourth filtrate; and sending at least a portion of the fourth filtrate to a third location (11) of the second recycled filtrate loop.

One embodiment provides a process, wherein the second recycled filtrate loop is not in fluid communication with the first recycled filtrate loop.

One embodiment provides a process, wherein the first recycled filtrate loop comprises a residual bleaching agent.

One embodiment provides a process, wherein the second recycled filtrate loop is substantially free of residual bleaching agent.

One embodiment provides a process, wherein the second recycled filtrate loop is in fluid communication with the first recycled filtrate loop to either control a fluid level in the first recycled filtrate loop, to dilute a residual bleaching agent level in the first recycled filtrate loop, or a combination thereof.

One embodiment provides a process, wherein the first recycled filtrate loop contains a higher concentration of residual bleaching agent than does the second recycled filtrate loop.

One embodiment provides a process, further comprising sending at least a portion of the fourth filtrate in the second recycled filtrate loop to an upstream storage tank.

One embodiment provides a process, further comprising sending at least a portion of the fourth filtrate in the second recycled filtrate loop to the first recycled filtrate loop to either control a fluid level in the first recycled filtrate loop, to dilute a residual bleaching agent level in the first recycled filtrate loop, or a combination thereof.

One embodiment provides a process, further comprising diluting the second pressed bleached pulp mixture prior to pressing or dewatering the second pressed bleached pulp mixture.

One embodiment provides a process, further comprising storing the bleached pulp.

One embodiment provides a process, further comprising one or more of sending at least a portion of the fourth filtrate in the second recycled filtrate loop to an upstream storage tank; sending at least a portion of the fourth filtrate in the second recycled filtrate loop upstream to the second location (9) in the second recycled filtrate loop, sending at least a portion of the fourth filtrate in the second recycling loop to the first recycled filtrate loop to either control a fluid level in the first recycled filtrate loop, to dilute a residual bleaching agent level in the first recycled filtrate loop, or a combination thereof or a combination thereof.

One embodiment provides a process, further comprising diluting the first bleached pulp mixture.

One embodiment provides a process, further comprising contacting and diluting the first bleached pulp mixture with a recycled filtrate obtained from a location (4) of the first recycled filtrate loop, wherein location (4) is downstream of the first location (3) and upstream of the second location (5).

One embodiment provides a process, wherein the first bleached pulp mixture has a consistency of about 12% before the diluting.

One embodiment provides a process, further comprising diluting the second bleached pulp mixture.

One embodiment provides a process, further comprising contacting and diluting the second bleached pulp mixture with a recycled filtrate obtained from a location (4) of the first recycled filtrate loop, wherein location (4) is downstream of the first location (3) and upstream of the second location (5).

One embodiment provides a process, wherein the second bleached pulp mixture has a consistency of about 30% before the diluting.

One embodiment provides a process, wherein the unbleached pulp mixture has a consistency of about 33-35%.

One embodiment provides a process, wherein the first pulp mixture has a first consistency of about 12%.

One embodiment provides a process, wherein the first pressed bleached pulp mixture has a consistency of about 33-35%.

One embodiment provides a process, wherein a second pulp mixture has a second consistency of about 30%.

One embodiment provides a process, wherein the second pressed bleached pulp mixture has a consistency of about 33-35%.

One embodiment provides a process, wherein the bleached pulp has a consistency of about 12%. and a third filtrate;

One embodiment provides a process, further comprising storing the bleached pulp.

One embodiment provides a process, further comprising pressing or dewatering the bleached pulp to a consistency of about 50%.

One embodiment provides a process, further comprising storing the second filtrate in a second first combined filtrate tank.

One embodiment provides a process, wherein the second combined filtrate tank is in fluid communication with the first recycled filtrate loop.

One embodiment provides a process, further comprising storing the third filtrate in a third combined filtrate tank.

One embodiment provides a process, wherein the third combined filtrate tank is in fluid communication with the first recycled filtrate loop.

One embodiment provides a process, further comprising controlling a fluid level in or diluting a residual bleaching agent concentration in the first recycled filtrate loop with a recycled filtrate obtained from a location (12) of a second recycled filtrate loop.

One embodiment provides a process, wherein a concentration of residual bleaching agent is higher in the first recycled filtrate loop than in the second recycled filtrate loop.

One embodiment provides a process, wherein the second recycled filtrate loop is in fluid communication with an upstream storage tank.

One embodiment provides a process, wherein the second recycled filtrate loop is in fluid communication with an upstream storage tank, and wherein the upstream storage tank is in fluid communication with a waste line or discharge line to discharge a recycled filtrate.

One embodiment provides a bleaching plant for making bleached pulp, comprising:

(a) at least one device configured to contact an unbleached pulp mixture with a first recycled filtrate obtained from a first location (3) of a first recycled filtrate loop and obtain a first pulp mixture having a first consistency;

(b) at least one device configured to bleach the first pulp mixture and obtain a first bleached pulp mixture;

(c) at least one device configured to press or dewater the first bleached pulp mixture and obtain a first pressed bleached pulp mixture and a second filtrate;

(d) at least one device configured to send at least a portion of the second filtrate to a second location (5) of the first recycled filtrate loop, wherein the second location (5) is downstream of and in fluid communication with the first location (3);

(e) at least one device configured to contact the first pressed bleached pulp mixture with a second recycled filtrate obtained from a third location (6) of the first recycled filtrate loop and obtain a second pulp mixture having a second consistency, wherein the second consistency is greater than the first consistency, and wherein the third location (6) is downstream of and in fluid communication with the second location (5);

(f) at least one device configured to bleach the second pulp mixture and obtain a second bleached pulp mixture;

(g) at least one device configured to press or dewater the second bleached pulp mixture and obtain a second pressed bleached pulp mixture and a third filtrate;

(h) at least one device configured to send at least a portion of the third filtrate to a fourth location (8) of the first recycled filtrate loop, wherein the fourth location (8) is downstream of and in fluid communication with the third location (6); and (i) at least one device configured to recycle at least a portion of the third filtrate in the first recycled filtrate loop to the first location (3); and obtain a bleached pulp.

One embodiment provides a process for making a paper product, comprising:

(a) contacting an unbleached pulp mixture with a first recycled filtrate obtained from a first location (3) of a first recycled filtrate loop, to obtain a first pulp mixture having a first consistency;

(b) bleaching the first pulp mixture, to obtain a first bleached pulp mixture;

(c) pressing or dewatering the first bleached pulp mixture, to obtain a first pressed bleached pulp mixture and a second filtrate;

(d) sending at least a portion of the second filtrate to a second location (5) of the first recycled filtrate loop, wherein the second location (5) is downstream of and in fluid communication with the first location (3);

(e) contacting the first pressed bleached pulp mixture with a second recycled filtrate obtained from a third location (6) of the first recycled filtrate loop, to obtain a second pulp mixture having a second consistency, wherein the second consistency is greater than the first consistency, and wherein the third location (6) is downstream of and in fluid communication with the second location (5);

(f) bleaching the second pulp mixture, to obtain a second bleached pulp mixture;

(g) pressing or dewatering the second bleached pulp mixture, to obtain a second pressed bleached pulp mixture and a third filtrate;

(h) sending at least a portion of the third filtrate to a fourth location (8) of the first recycled filtrate loop, wherein the fourth location (8) is downstream of and in fluid communication with the third location (6);

(i) recycling at least a portion of the third filtrate in the first recycled filtrate loop to the first location (3);

to obtain the bleached pulp; and producing a paper product from at least a portion of the bleached pulp.

One embodiment provides a papermaking plant for making a paper product, comprising:

(a) at least one device configured to contact an unbleached pulp mixture with a first recycled filtrate obtained from a first location (3) of a first recycled filtrate loop and obtain a first pulp mixture having a first consistency;

(b) at least one device configured to bleach the first pulp mixture and obtain a first bleached pulp mixture;

(c) at least one device configured to press or dewater the first bleached pulp mixture and obtain a first pressed bleached pulp mixture and a second filtrate;

(d) at least one device configured to send at least a portion of the second filtrate to a second location (5) of the first recycled filtrate loop, wherein the second location (5) is downstream of and in fluid communication with the first location (3);

(e) at least one device configured to contact the first pressed bleached pulp mixture with a second recycled filtrate obtained from a third location (6) of the first recycled filtrate loop and obtain a second pulp mixture having a second consistency, wherein the second consistency is greater than the first consistency, and wherein the third location (6) is downstream of and in fluid communication with the second location (5);

(f) at least one device configured to bleach the second pulp mixture and obtain a second bleached pulp mixture;

(g) at least one device configured to press or dewater the second bleached pulp mixture and obtain a second pressed bleached pulp mixture and a third filtrate;

(h) at least one device configured to send at least a portion of the third filtrate to a fourth location (8) of the first recycled filtrate loop, wherein the fourth location (8) is downstream of and in fluid communication with the third location (6);

(i) at least one device configured to recycle at least a portion of the third filtrate in the first recycled filtrate loop to the first location (3); and obtain a bleached pulp; and a device configured to produce a paper product from at least a portion of the bleached pulp.

In one embodiment, the filtrate recycling flow includes sending the filtrate from a fourth combined filtrate tank to an upstream storage tank.

In one embodiment, the filtrate from a second combined filtrate tank is used for level control of a third combined filtrate tank.

In one embodiment, the filtrate from a fourth combined filtrate tank is used for level control of a second combined filtrate tank.

In one embodiment, the filtrate recycling flow is from a fourth combined filtrate tank to a second combined filtrate tank to an upstream storage tank.

In one embodiment, the filtrate recycling flow is from a fourth combined filtrate tank to a second combined filtrate tank to a first combined filtrate tank to an upstream storage tank.

In one embodiment, the filtrate recycling flow is from a fourth combined filtrate tank to a second combined filtrate tank to a first combined filtrate tank to discharge.

In one embodiment, the filtrate recycling flow is from a second combined filtrate tank to a third combined filtrate tank to a first combined filtrate tank to an upstream storage tank.

In one embodiment, the filtrate stream may be divided into at least two streams as it is recycled: (1) for pulp consistency make up; and (2) for tank level control.

Figure 2:
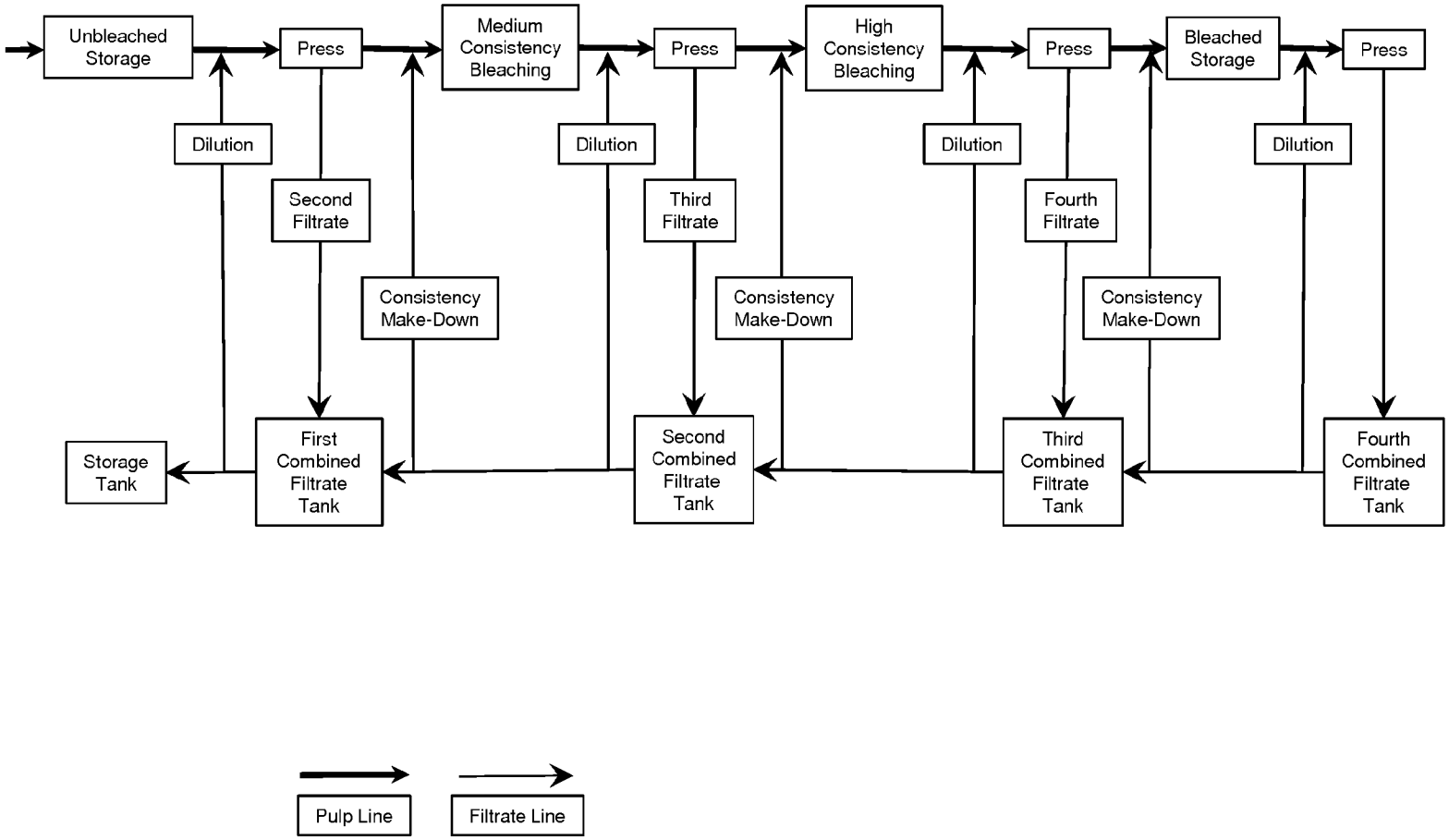
FIG. 2 shows a conventional countercurrent filtrate recycling process.
Figure 3:
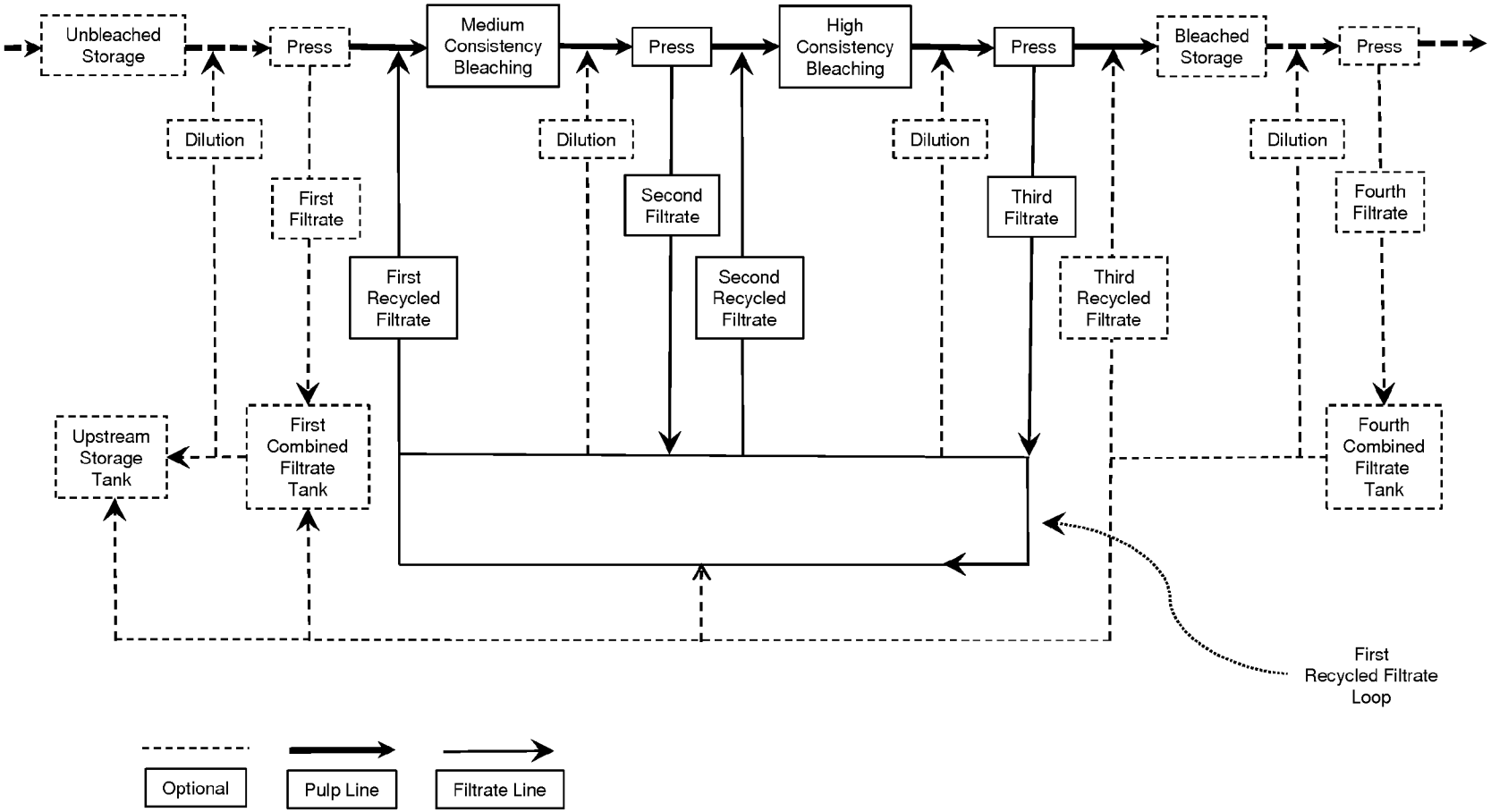
FIG. 3 shows a diagram of one embodiment of the disclosure.
Figure 4:
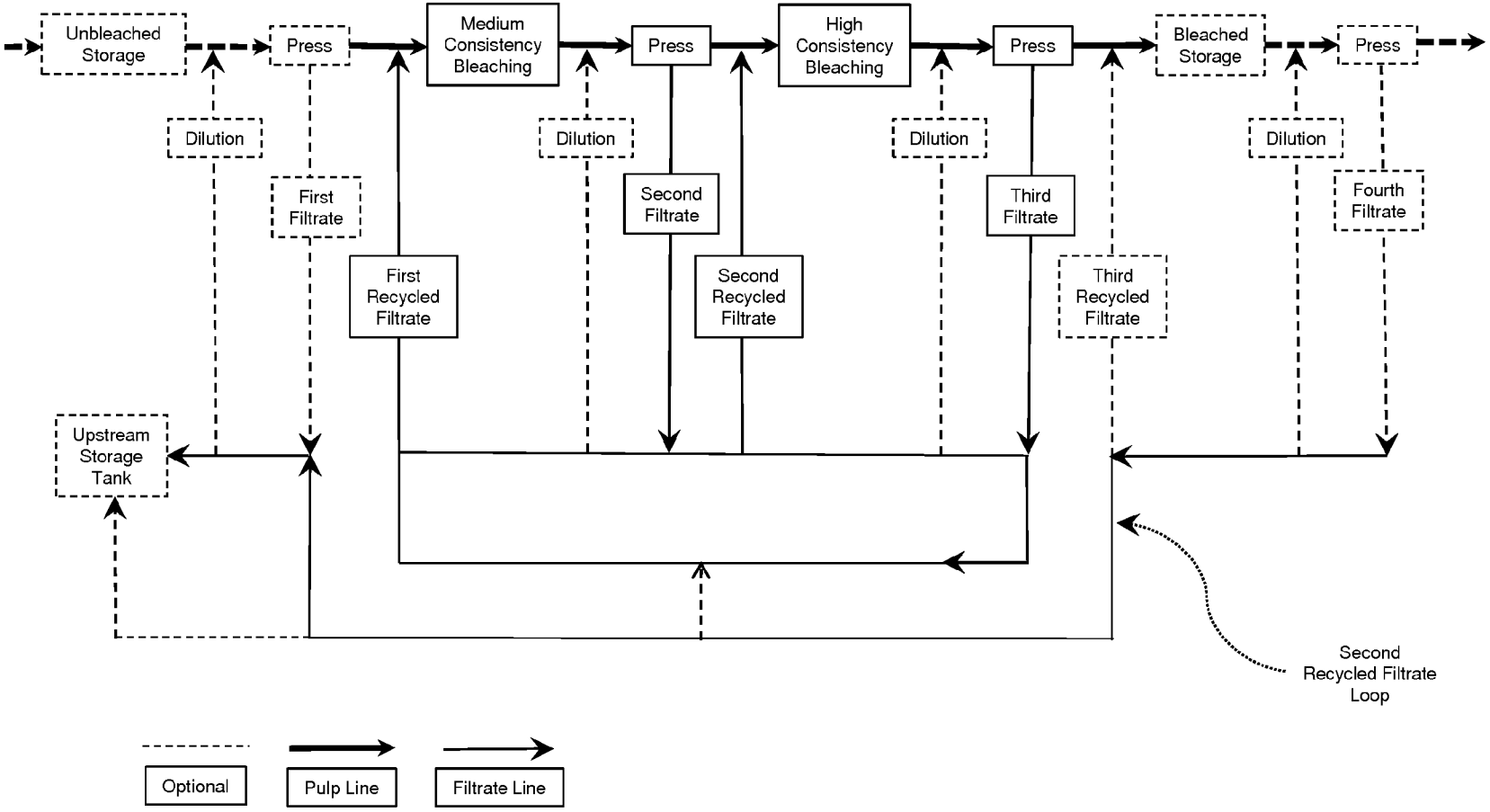
FIG. 4 shows a diagram of another embodiment of the disclosure.
Figure 5:
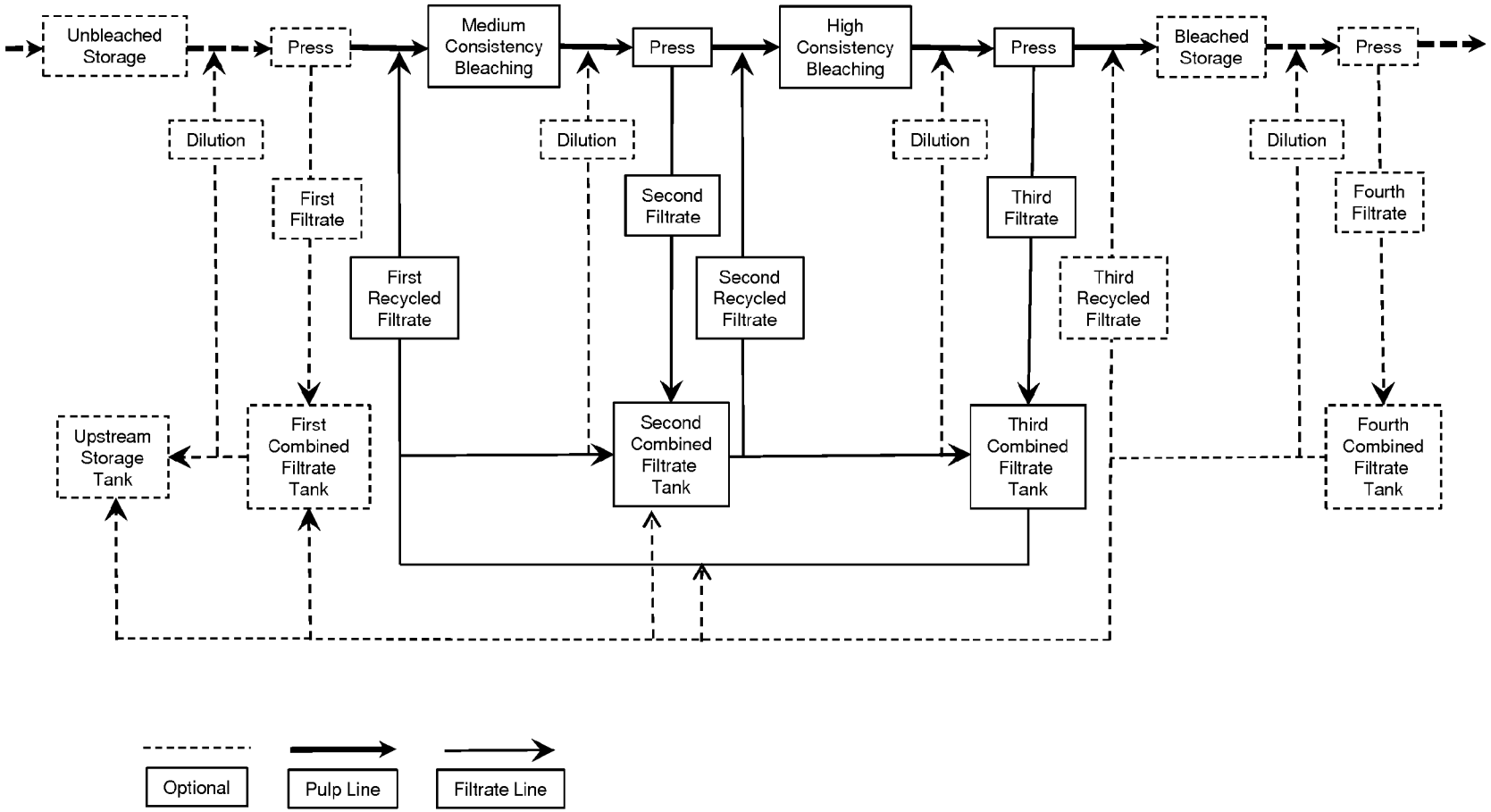
FIG. 5 shows a diagram of another embodiment of the disclosure.
Figure 6:
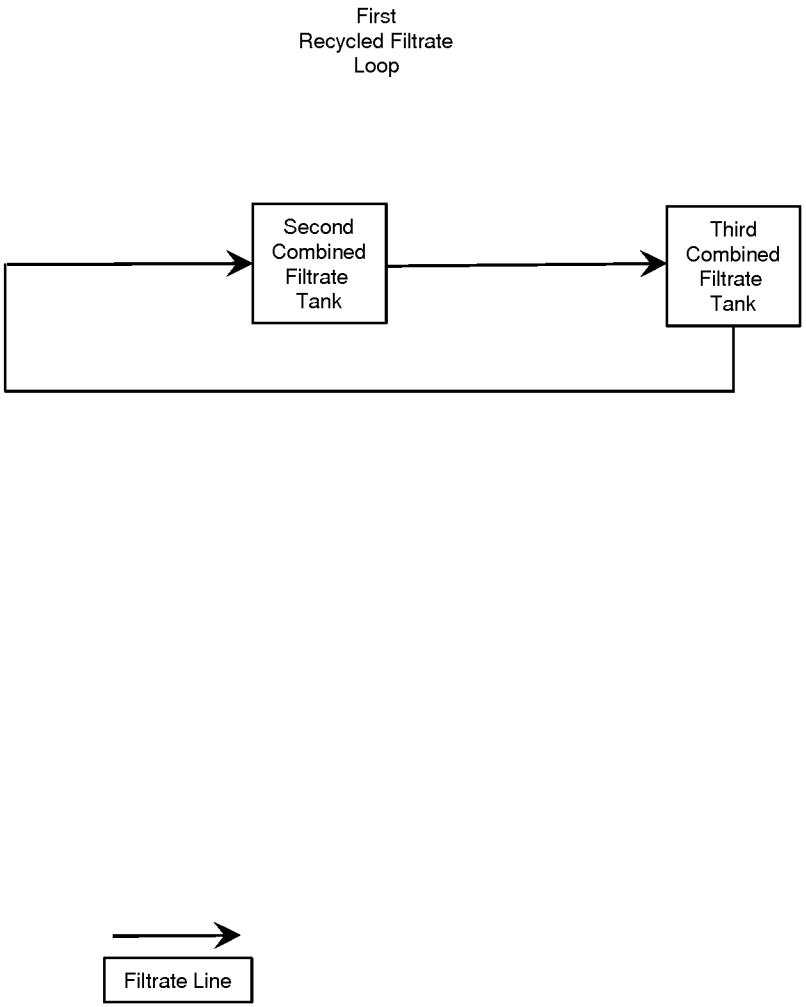
FIG. 6 shows a diagram of another embodiment of the disclosure.
Figure 7:
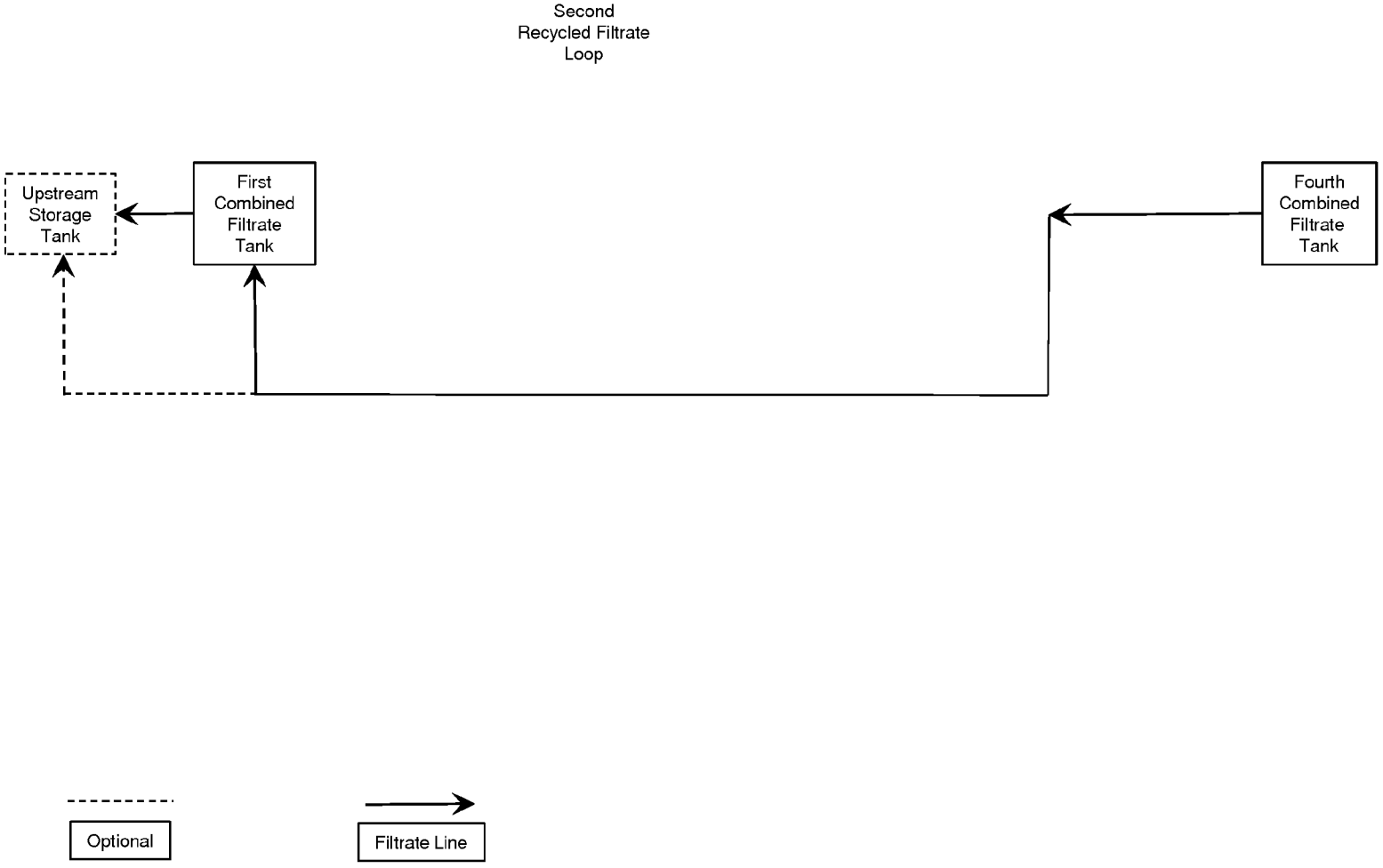
FIG. 7 shows a diagram of another embodiment of the disclosure.
Figure 8:
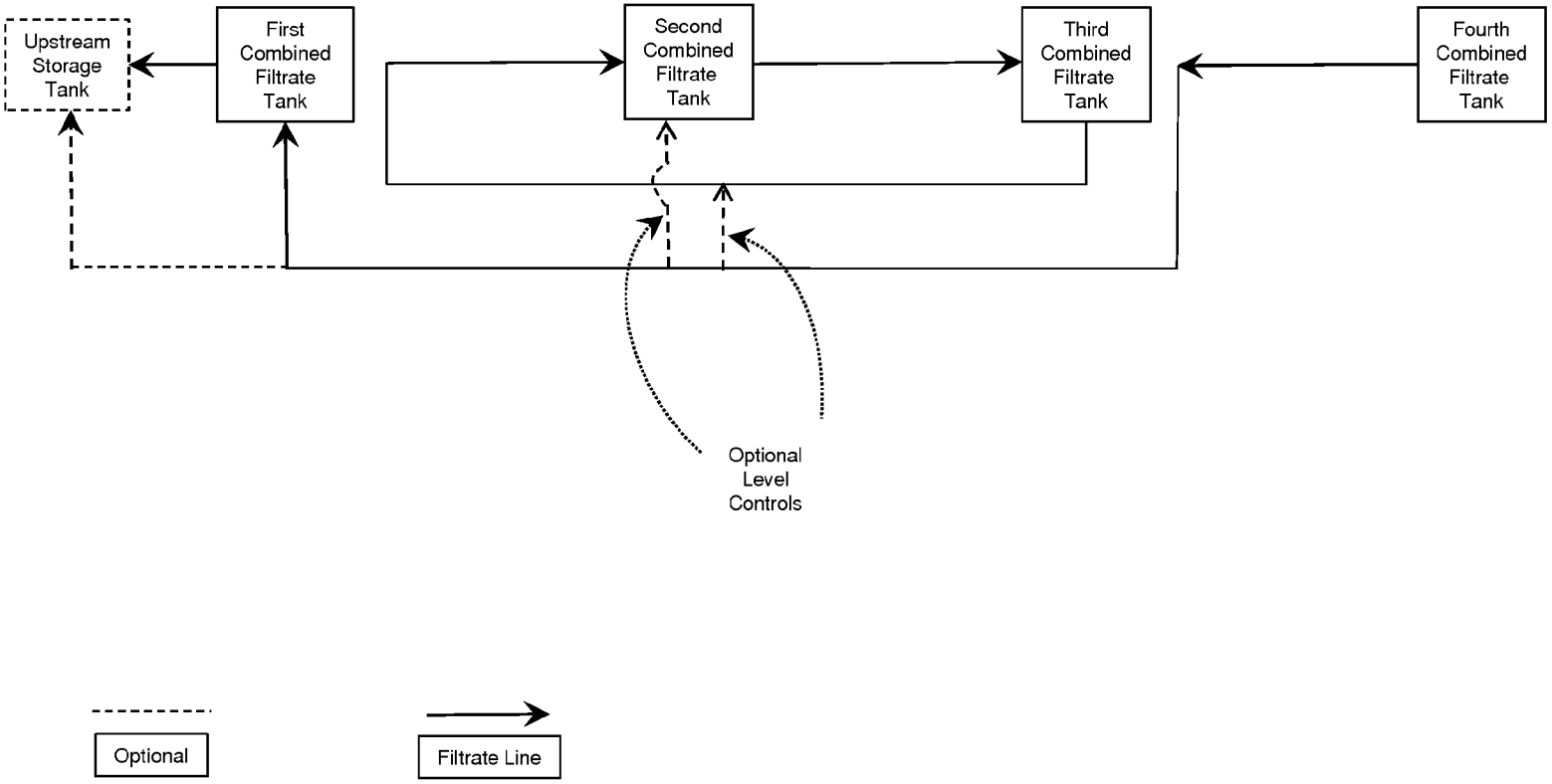
FIG. 8 shows a diagram of another embodiment of the disclosure.
Figure 9:
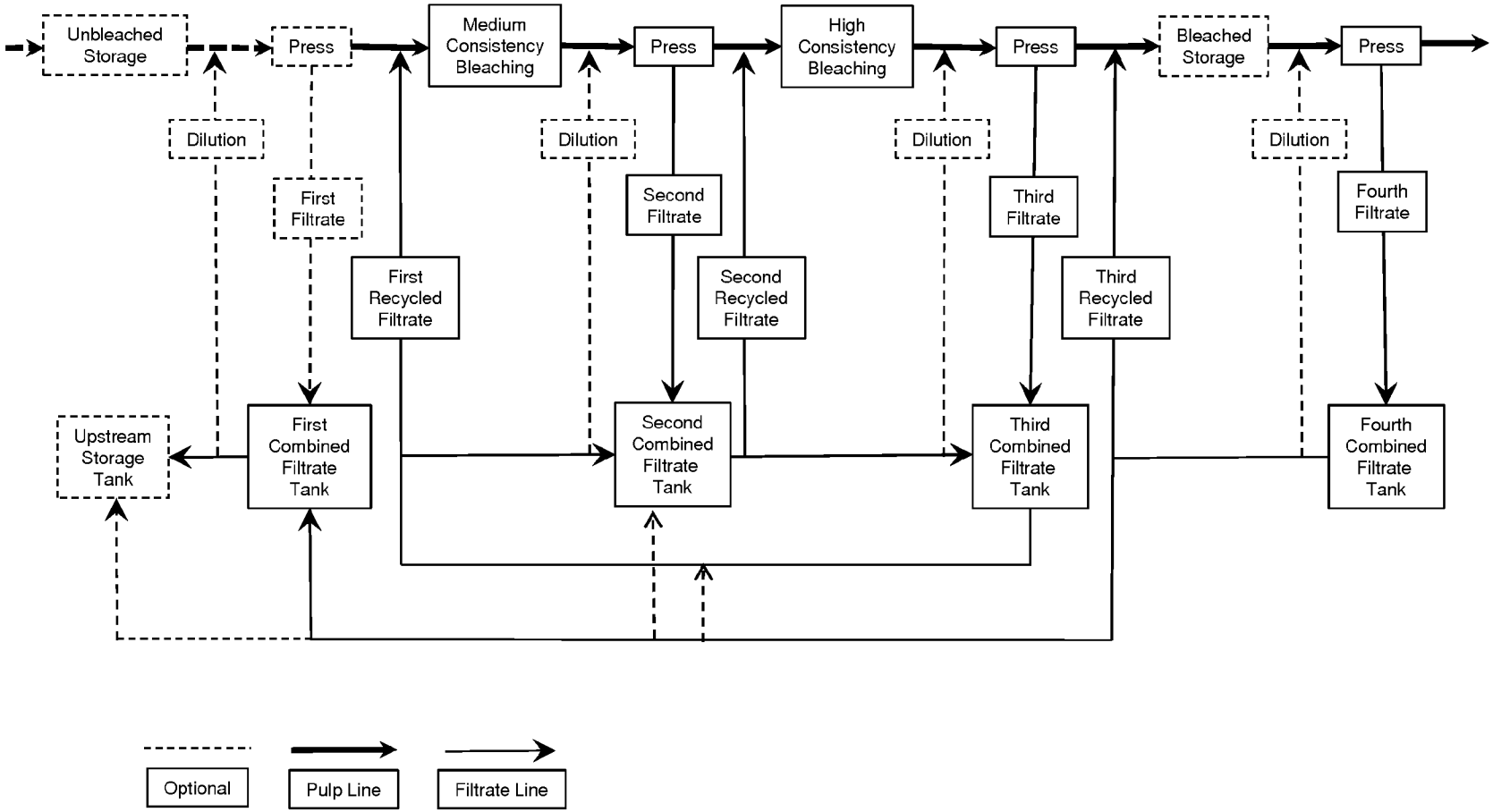
FIG. 9 shows a diagram of another embodiment of the disclosure.
Figure 10:
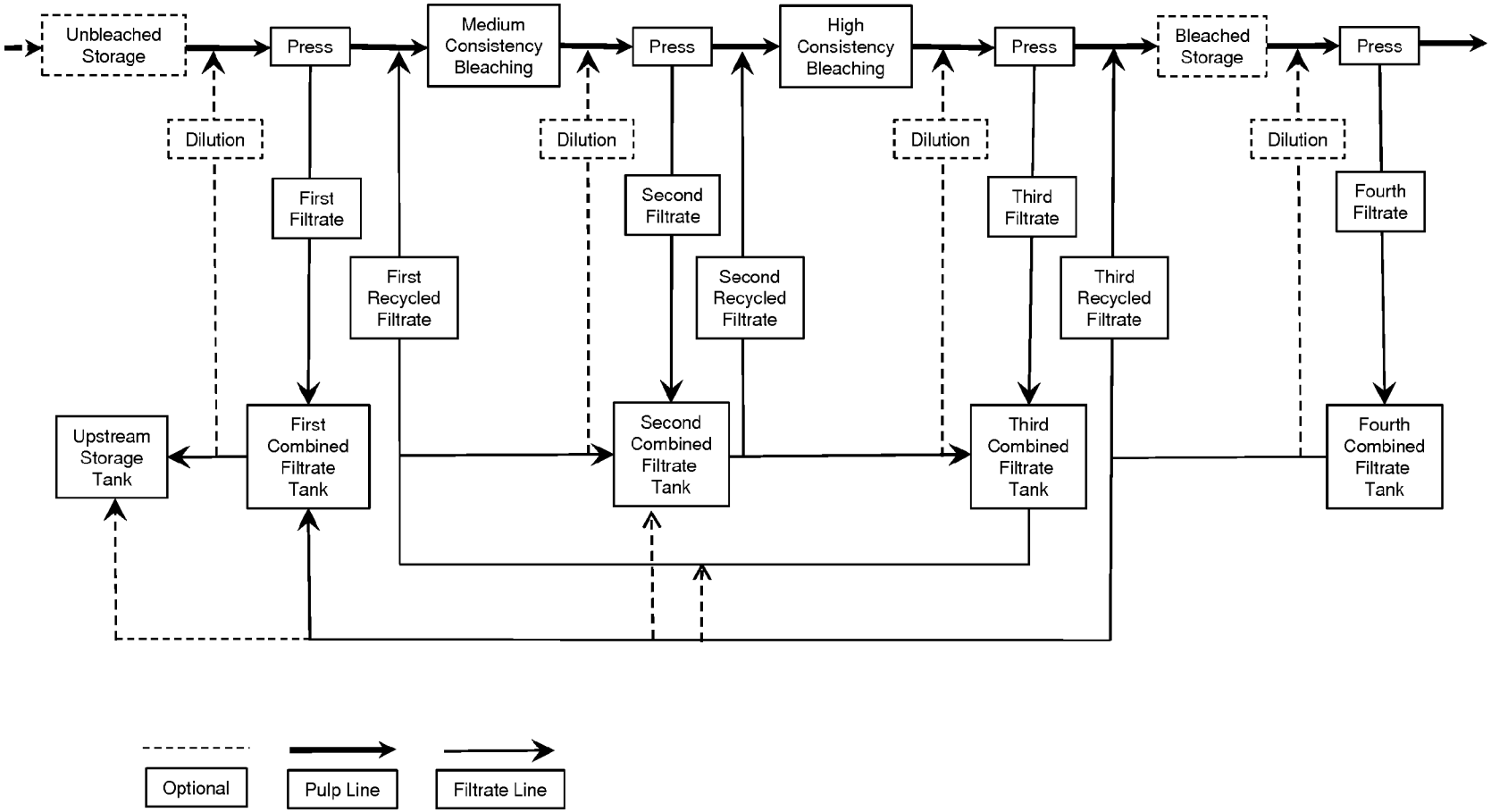
FIG. 10 shows a diagram of another embodiment of the disclosure.
Figure 11:
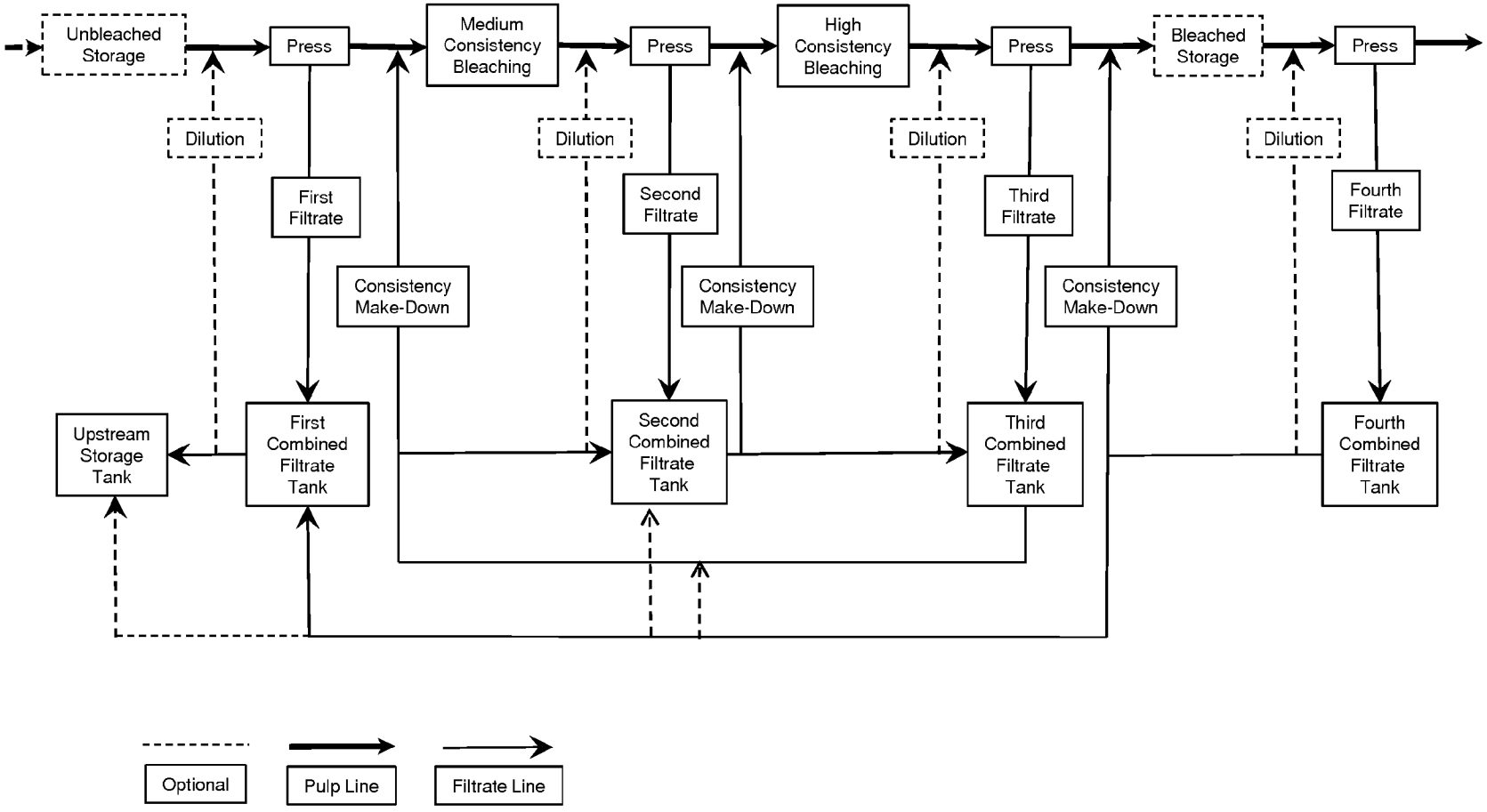
FIG. 11 shows a diagram of another embodiment of the disclosure.
Figure 12:
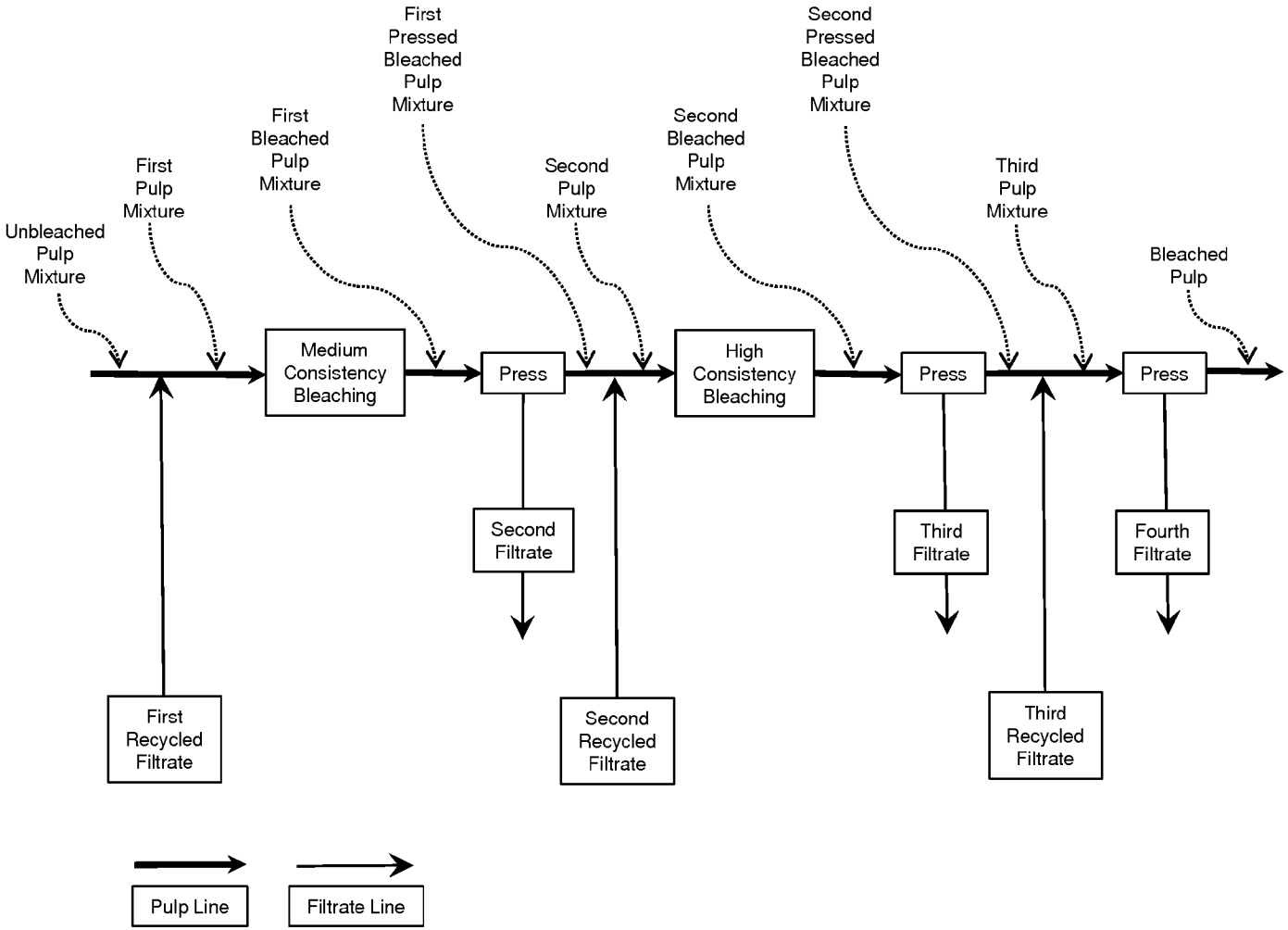
FIG. 12 shows a diagram of another embodiment of the disclosure.
Figure 13:
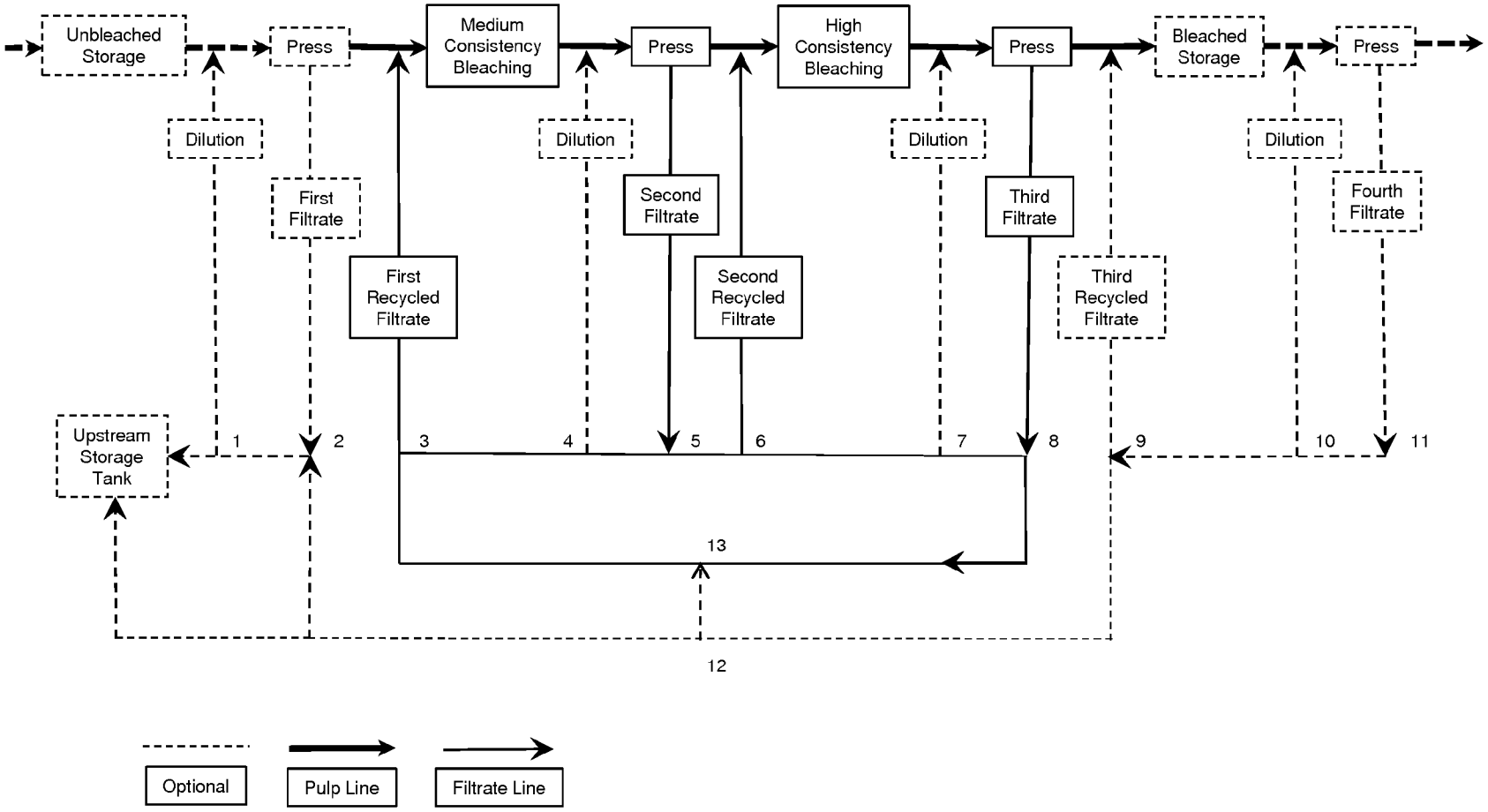
FIG. 13 shows a diagram of another embodiment of the disclosure. Location numbers along the respective recycled filtrate loops are shown. The location numbers are included only for identification, and are not intended to limit either order of use or number of locations used.

Currently, in typical countercurrent filtrate recycling, such as shown in FIG. 2, the upstream filtrate flow from tank to tank is as follows: from a fourth combined filtrate tank to a third combined filtrate tank to a second combined filtrate tank to a first combined filtrate tank to an upstream storage tank. The "upstream" process direction for the filtrate in typical countercurrent filtrate recycling is generally opposed to the "downstream" process direction for the pulp. For example, as the pulp moves downstream through various bleaching and pressing steps, the filtrate that results from pressing the pulp is recycled in the upstream direction.

The terms, "upstream" and "downstream" are considered in the context of the overall process direction of the pulp. For example, in a process of making paper, the pulping stage is generally upstream of the bleaching stage, which, in turn, is generally upstream of the papermaking stage.

The term, "forward" or "downstream" shall refer to the process direction of the pulp. For example, the pulp is considered to move forward as it passes from the pulping stage through the bleaching stage and to the papermaking stage.

The term, "backward" or "upstream" shall refer to a direction that is generally opposed to the downstream process direction of the pulp. The term may also refer to an upstream location, e.g., an "upstream" storage tank can refer to a storage tank that is located somewhere upstream.

The term, "filtrate" shall generally refer to an aqueous phase that is collected, recovered, or separated from a mixture of said phase and pulp. The aqueous phase may contain water, dissolved and/or suspended materials, and the like. The filtrate may also contain a residual amount of pulp depending on the limit of separation as is customary in the pulp and papermaking arts.

The terms, "countercurrent", "countercurrently", and the like, shall refer to the direct or indirect flow in the upstream direction, i.e., in a direction that is generally opposite that of the overall process direction of the pulp. For example, in a countercurrent recycling process wherein a mixture of pulp and water is dewatered, the resulting filtrate may be reused in an upstream process, while the separated pulp moves forward in the downstream direction.

Another view of conventional countercurrent filtrate recycling is shown in FIG. 2.

The term, "consistency" shall is the term used to describe the solid content of pulp in a pulp composition (e.g., a composition comprising at least pulp and water), and is generally reported as the percentage is the percent by weight of pulp based on the total weight of the pulp composition. The standard procedure of measuring pulp consistency (up to 25%) is laid out in TAPPI T240, incorporated herein by reference.

In one embodiment, pulp consistency may suitably range from 1 to 100%. This includes all values and subranges therebetween, including 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 55, 60, 65, 70, 75, 80, 85, 90, 95, and 100%, or any combination thereof.

In one embodiment, the first bleached pulp mixture has a consistency of about 5 to 20%. This range includes all values and subranges therebetween, including 5, 6, 7, 8, 9, 10, 11, 12, 13, 14, 15, 16, 17, 18, 19, and 20%.

In one embodiment, the second bleached pulp mixture has a consistency of about >20 and higher. This range includes all values and subranges therebetween, including >20, 21, 22, 23, 24, 25, 26, 27, 28, 29, 30, 35, 40, 45, 50, 55, 60, 65, 70, 75, 80, 85, 90, 95, and 100%.

In one embodiment, the unbleached pulp mixture has a consistency of about >20 and higher. This range includes all values and subranges therebetween, including >20, 21, 22, 23, 24, 25, 26, 27, 28, 29, 30, 35, 40, 45, 50, 55, 60, 65, 70, 75, 80, 85, 90, 95, and 100%.

In one embodiment, the first pulp mixture has a consistency of about 5 to 20%. This range includes all values and subranges therebetween, including 5, 6, 7, 8, 9, 10, 11, 12, 13, 14, 15, 16, 17, 18, 19, and 20%.

In one embodiment, the first pressed bleached pulp mixture has a consistency of about >20 and higher. This range includes all values and subranges therebetween, including >20, 21, 22, 23, 24, 25, 26, 27, 28, 29, 30, 35, 40, 45, 50, 55, 60, 65, 70, 75, 80, 85, 90, 95, and 100%.

In one embodiment, the second pulp mixture has a consistency of about >20 and higher. This range includes all values and subranges therebetween, including >20, 21, 22, 23, 24, 25, 26, 27, 28, 29, 30, 35, 40, 45, 50, 55, 60, 65, 70, 75, 80, 85, 90, 95, and 100%.

In one embodiment, the second pressed bleached pulp mixture has a consistency of about >20 and higher. This range includes all values and subranges therebetween, including >20, 21, 22, 23, 24, 25, 26, 27, 28, 29, 30, 35, 40, 45, 50, 55, 60, 65, 70, 75, 80, 85, 90, 95, and 100%.

In one embodiment, the bleached pulp has a consistency of about 5 to 20%. This range includes all values and subranges therebetween, including 5, 6, 7, 8, 9, 10, 11, 12, 13, 14, 15, 16, 17, 18, 19, and 20%.

In another embodiment, the bleached pulp may be further pressed or dewatered in one or more pressing or dewatering steps to a consistency of about >20 and higher. This range includes all values and subranges therebetween, including >20, 21, 22, 23, 24, 25, 26, 27, 28, 29, 30, 35, 40, 45, 50, 55, 60, 65, 70, 75, 80, 85, 90, 95, and 100%.

In one embodiment, low consistency may have a range of 0 to <5%, medium consistency may have a range of 5 to 20%, and high consistency may have a range of >20% and higher.

The pulp is not particularly limited, and any conventional pulps may be considered to be within the scope of this disclosure. Some examples of pulps, which are not intended to be limiting, include fully mechanical (GW, PGW, RMP), mechanical & thermal (TMP), semi-mechanical, semi-chemical (CTMP), semi-chemical (NSSC, cold soda), fully chemical (sulfite, sulfate), soft cook fully chemical (rayon, viscose), wood (HW, SW), agricultural residue (straw), annual plants & grasses (hemp, jute, kenaf, bamboo), rags, recycled or secondary fiber, deinked, totally chlorine free (TCF), elemental chlorine free, (ECF), chlorine bleaching (chlorine gas & hypochlorite), oxygen/ozone bleached, very high yield (>95%), GW, PGW, high yield (85-95%), RMP, TMP, medium high yield (65-85%), CTMP, NSSC, CMP, medium yield (45-65%), sulfite, sulfate, medium low yield (35-45%), straw, grass, bagasse chemical pulp, low yield (<35%), rayon, viscose, long fiber pulp (>10 mm), cotton, hemp, flax, jute, medium fiber pulp (2-10 mm), Northern S/W, H/W, short fiber pulp (<2 mm), tropical H/W, straws, grasses, aspen, North American Populus tremuloides, European Populus tremuloides, Asian Populus tremuloides, eucalyptus, birch, combinations thereof, and the like.

In one embodiment, the bleached pulp includes chemithermomechanical Pulp (CTMP) or market pulp. In one embodiment, the bleached pulp that results from the process described herein is bleached chemical thermomechanical pulp (BCTMP).

The bleached pulp may suitably be used in one or more papermaking processes, to produce a paper product. The paper product is not particularly limited. Some examples of paper products, which are not intended to be limiting, include tissue (low weight, <40 gsm), paper (medium weight, 40-120 gsm), paperboard (medium high weight, 120-200 gsm), board (high weight, >200 gsm), white, colored, industrial, packaging, wrapping, filtering, electrical, writing, printing, newspaper, currency, food wrapping, candy wrapping, coffee filter, tea bag, paper made from wood, agricultural residue, straw, grass, other annual plants, recycled fiber, secondary fiber, coated, uncoated, laminated, calendared, supercalendared, machine finished, machine glazed, gloss, combinations thereof, and the like.

Any conventional bleach or process chemicals can be used, which are known in the pulp and paper art and which are not particularly limiting. Some examples of bleach or process chemicals include acid wash, boron hydride salts, $NaBH_4$, chlorine, chlorine dioxide, alkaline, formamidine sulfinic acid, sodium hydroxide, $Na_2SO_3$, sodium hypo-chlorite, chlorine monoxide, hypochlorous compounds, nitrogen compounds, oxygen, hydrogen peroxide, peracetic acid, oxalate, $CH_3COOOH$, chelates, xylanase, sodium hydrosulfite, ozone, or a combination thereof. In one embodiment, the bleaching agent includes hydrogen peroxide.

In one embodiment, non-chlorine-containing bleach is utilized. In one embodiment, oxidative bleach is utilized. In one embodiment, non-oxidative bleach is utilized. In one embodiment, Bleach concentration, bleaching times, and bleaching temperatures may be suitably selected given the teachings herein and the skill of one in the paper and pulp bleaching arts.

For example, the bleaching time may suitably range from 15 minutes to several hours. This range includes all values and subranges therebetween, including 15, 20, 25, 30, 35, 40, 45, 50, 55 minutes, 1.1, 1.2, 1.3, 1.4, 1.5, 1.6, 1.7, 1.8, 1.9, 2, 2.0, 3, 4, 5, and 6 hours, or any combination thereof.

For example, the bleaching temperature may suitably range from 20° C. to 200° C. This range includes all values and subranges therebetween, including 20, 25, 30, 35, 40, 45, 50, 55, 60, 65, 70, 75, 80, 85, 90, 95, 100, 105, 110, 115, 120, 125, 130, 135, 140, 145, 150, 160, 170, 180, 190, and 200° C., or any combination thereof.

In one embodiment, in the bleached pulp, a brightness ranging from about 50-100% may be achieved, which range includes all values and subranges therebetween. This includes brightness values of 50, 55, 60, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, and 100%.

In one embodiment, step (b) comprises medium consistency (or "MC") bleaching.

In one embodiment, step (f) comprises high consistency (or "HC") bleaching.

In one embodiment, bypassing the filtrate from a fourth combined filtrate tank from MC and HC bleach plant reuses more peroxide residual from HC and MC stages. One embodiment includes bypassing the filtrate from a fourth combined filtrate tank to an upstream storage tank. One embodiment includes using the filtrate from a second combined filtrate tank for level control of a third combined filtrate tank. One embodiment includes using filtrate from a fourth combined filtrate tank for the level control of a second combined filtrate tank.

In one embodiment, sending all or part of the fourth filtrate to a discharge stream or wastewater reduces the organics (e.g., organic acids) and metal buildup in the filtrate system. In another embodiment, discharging all or part of the fourth filtrate reduces bleaching chemical usage, wastewater COD (chemical oxygen demand) loading, wastewater pH buffering effect, and adverse effect on coagulation chemistry in primary DAF.

In one embodiment, recycling of peroxide filtrate to Ca oxalate sensitive operation is reduced or eliminated.

In one embodiment, the bleaching process may be suitably used in combination with other and well-known pulp processes. For example, the bleaching process may be suitably used with one or more chemical pretreatment and refining processes, such as, for example, in the order chemical pretreatment, refining, and then bleaching. In one embodiment, peroxide bleaching is used.

In one embodiment, chemical pretreatment of chips decreases refining energy, achieves shives reduction, and develops pulp strength properties. However, the inventors have found that chemical treatment also leads to a significant pulp yield loss and associated increase in raw wastewater COD as well as reduction in such pulp properties as bulk, freeness, and opacity.

In one embodiment, two chemicals (NaOH and $Na_2SO_3$) are used in chemical pretreatment (e.g., for hardwood pulp). In one embodiment, only $Na_2SO_3$ is used for softwood chemical pretreatment.

In one embodiment, the unbleached pulp is refined prior to bleaching. In one embodiment, refining is carried out to reduce shives content of BCTMP pulp and develop pulp strength properties (e.g., tensile) and brightness. It may also lead to a reduction in bulk, freeness, and opacity. In one embodiment, the refining operation is controlled by the freeness target.

In one embodiment, peroxide bleaching is used for development of brightness that dictates the amount of peroxide and caustic (APR or alkali to peroxide ratio) usage. Bleaching also increases pulp strength properties (tensile); decrease opacity, freeness, and bulk; and increase effluent COD loadings.

The pulp bleachability and bleaching chemical usage may be governed by unbleached pulp brightness affected by wood quality (freshness and moisture content in wood storage), transition (Mn, Fe, Cu) metal content, and chemical pretreatment conditions, peroxide bleaching conditions such as APR, consistency, pH, temperature, mixing, time, water quality and filtrate recycling.

In one embodiment, shown in the Table 1 below, the following amounts are used in peroxide bleaching:

Chemical Usages and Conditions in Peroxide Bleaching

| | 85% Brightness | 70% Brightness |
|---|---|---|
| MC Stage | 4-5 kg/t peroxide<br>10-15 kg/t NaOH<br>70° C.<br>3 hr<br>72% Brightness | |
| HC Stage | 48 kg/t peroxide<br>28 kg/t NaOH<br>15 kg/t Na Silicate<br>75° C.<br>3 hr<br>85% Brightness | 10 kg/t peroxide<br>8 kg/t NaOH<br>8 kg/t Na Silicate<br>75° C.<br>3 hr<br>70-75% Brightness |
| Metal Management | 2 kg/t DTPA in chemical impregnation and latency chest each | |

In one embodiment, about 10 kgl/NaOH and $Na_2SO_3$ each in chemical pretreatment for 70% brightness and 8 kg/t of both chemicals for 85% brightness along with 2 kg/t DTPA for metal chelation may be used.

In one embodiment, the total caustic charge in chemical pretreatment and peroxide bleaching are minimized in view of achieving good BCTMP pulp bulk. A threshold amount of caustic usage in peroxide bleaching is desirably maintained to reach a certain brightness target. The inventors have found that a best way to achieve for high bulk (also opacity) is therefore to minimize the caustic usage during chemical pretreatment (impregnation).

In one embodiment, the peroxide is more efficiently consumed, the residual peroxide is more effectively reused, metal management is improved.

In one embodiment, the unbleached pulp and recycled filtrate metal may be desirably checked during the process. In one embodiment, DTPA application rate and point of application are optimized.

The required amount of caustic usage in peroxide bleaching may be governed by the ability to consume peroxide (no consumption, no brightness). In one embodiment, in peroxide bleaching, the alkali to peroxide ratio (APR) may be optimized by increasing caustic usage and reducing peroxide charge in both stages to improve peroxide consumption and brightness. This will reduce bleaching cost reduction as well as peroxide residual in BCTMP wastewater benefiting the WWTP operation. In one embodiment, the amount of $H_2O_2$ used in an MC peroxide bleaching stage may be reduced.

As shown in FIG. 2, in conventional countercurrent filtrate recycling, the filtrate moves upstream from a fourth combined filtrate tank (press after bleached storage) to a third combined filtrate tank (press after HC tower) to a second combined filtrate tank (press after MC tower) to a first combined filtrate tank (press after unbleached storage) to an upstream storage tank (storage for all mill process filtrates including the filtrate from disc filter after screening). The combined filtrate from the upstream storage tank is used for dilution water of all over the BCTMP operations (chip washing, impregnation, latency chest, screen/cleaner, refining, and MC/HC towers, etc).

In one embodiment, the process results in reduced effluent.

Conventional filtrate recycling accumulates contaminants such as metals, pitch, fines, organic acids including resin and fatty acids that can affect unbleached pulp brightness and peroxide bleachability when recycled to peroxide bleaching. The transition metals enter the system mainly with the wood and also with chemicals, mill water, or recycled filtrate.

The high peroxide residual in filtrate reacts with dissolved solids and organics in the same effect as peroxide oxidation to increase filtrate organic acids, contributing to pH buffering.

The net results of filtrate countercurrent recycling or water circuit closure are therefore increased chemical consumption, operating issues such as pH buffering and scale, high wastewater loadings, and poor wastewater treatability in WWTP (waste water treatment plant). In one embodiment, one or more metal and organics purge point is provided in the process line to avoid accumulation of metal and organic concentration to a level that inhibits peroxide bleaching efficiency and causing operating issues such as pH buffering and scale.

In one embodiment, skip the filtrate from a fourth combined filtrate tank containing no residual peroxide recycled to the HC and MC filtrate tanks so that the amount of high peroxide residual (in one embodiment amounting to 30 kg/t and 28 kg/t peroxide in the HC and MC filtrates respectively) can be accommodated in peroxide bleaching to reduce the peroxide usage as well as to decrease peroxide residual to the WWTP. The reduced peroxide residual in the filtrate circuit can also reduce the amount of organic acids formation, minimizing the effect on pH buffering. In one embodiment, the filtrate from the a fourth combined filtrate tank is bypassed to an upstream storage tank, use the filtrate from a second combined filtrate tank for level control of a third combined filtrate tank and filtrate from a fourth combined filtrate tank for the level control of a second combined filtrate tank to reduce peroxide usage and residual level in the filtrate/wastewater.

In one embodiment, a BCTMP process includes the process for making bleached pulp described herein.

In one embodiment, a BCTMP plant includes the bleaching plant described herein.

One embodiment relates to a BCTMP process, which includes chip washing, impregnation, $1^{st}$ stage refining, $2^{nd}$ stage refining, screening, reject refining, cleaning, MC bleaching, HC bleaching, washing, and storage, and which includes the process for making bleached pulp described herein.

One embodiment relates to a BCTMP plant, which includes unit operations for one or more of chip washing, impregnation, $1^{st}$ stage refining, $2^{nd}$ stage refining, screening, reject refining, cleaning, MC bleaching, HC bleaching, washing, and storage, and which includes the plant for making bleached pulp described herein.

Numerous modifications and variations on the present invention are possible in light of the above teachings. It is, therefore, to be understood that within the scope of the accompanying claims, the invention may be practiced otherwise than as specifically described herein.

What is claimed is:

1. A bleaching plant for making bleached pulp, comprising:

(a1) at least one device configured to press or dewater a first unbleached pulp mixture to produce an unbleached pulp mixture and a first filtrate;

(a2) at least one device configured to send at least a portion of the first filtrate to a first location (2) of a second recycled filtrate loop;

(a3) at least one device configured to contact the unbleached pulp mixture with a first recycled filtrate obtained from a first location (3) of a first recycled filtrate loop and obtain a first pulp mixture having a first consistency;

(b) at least one device configured to bleach the first pulp mixture and obtain a first bleached pulp mixture;

(c) at least one device configured to press or dewater the first bleached pulp mixture and obtain a first pressed or dewatered bleached pulp mixture and a second filtrate;

(d) at least one device configured to send at least a portion of the second filtrate to a second location (5) of the first recycled filtrate loop, wherein the second location (5) is downstream of and in fluid communication with the first location (3);

(e) at least one device configured to contact the first pressed or dewatered bleached pulp mixture with a second recycled filtrate obtained from a third location (6) of the first recycled filtrate loop and obtain a second pulp mixture having a second consistency, wherein the second consistency is greater than the first consistency, and wherein the third location (6) is downstream of and in fluid communication with the second location (5);

(f) at least one device configured to bleach the second pulp mixture and obtain a second bleached pulp mixture;

(g) at least one device configured to press or dewater the second bleached pulp mixture and obtain a second pressed or dewatered bleached pulp mixture and a third filtrate;

(h) at least one device configured to send at least a portion of the third filtrate to a fourth location (8) of the first recycled filtrate loop, wherein the fourth location (8) is downstream of and in fluid communication with the third location (6); and (i) at least one device configured to recycle at least a portion of the third filtrate in the first recycled filtrate loop to the first location (3); and obtain a bleached pulp;

wherein the second recycled filtrate loop is in fluid communication with the first recycled filtrate loop to either control a fluid level in the first recycled filtrate loop, to dilute a residual bleaching agent level in the first recycled filtrate loop, or a combination thereof.

2. A papermaking plant for making a paper product, comprising:

the plant of claim 1; and a device configured to produce a paper product from at least a portion of the bleached pulp.

3. The bleaching plant of claim 1, further comprising at least one device for one or more of: sending at least a portion of the first filtrate in the second recycled filtrate loop to an upstream storage tank; or sending at least a portion of the first filtrate in the second recycled filtrate loop upstream to dilute the first unbleached pulp mixture prior to the first unbleached pulp mixture being dewatered by the device (a1).

4. The bleaching plant of claim 1, further comprising a second combined filtrate tank for storing the second filtrate.

5. The bleaching plant of claim 4, wherein the second combined filtrate tank is in fluid communication with the first recycled filtrate loop.

6. The bleaching plant of claim 1, further comprising a third combined filtrate tank for storing the third filtrate.

7. The bleaching plant of claim 6, wherein third combined filtrate tank is in fluid communication with the first recycled filtrate loop.

8. The bleaching plant of claim 1, further comprising an upstream storage tank, and wherein the second recycled filtrate loop is in fluid communication with the upstream storage tank.

9. The bleaching plant of claim 8, wherein the upstream storage tank is in fluid communication with a waste line or discharge line to discharge recycled filtrate.

* * * * *